US011441842B2

(12) United States Patent
Felden

(10) Patent No.: US 11,441,842 B2
(45) Date of Patent: Sep. 13, 2022

(54) APPARATUS AND METHOD FOR REMOVING MOISTURE FROM A SURFACE IN A CONTAINER

(71) Applicant: MERCK PATENT GMBH, Darmstadt (DE)

(72) Inventor: Luc Felden, Andolsheim (FR)

(73) Assignee: MERCK PATENT GMBH, Darmstadt (DE)

( * ) Notice: Subject to any disclaimer, the term of this patent is extended or adjusted under 35 U.S.C. 154(b) by 1103 days.

(21) Appl. No.: 15/302,667

(22) PCT Filed: Mar. 18, 2015

(86) PCT No.: PCT/EP2015/000594
§ 371 (c)(1),
(2) Date: Oct. 7, 2016

(87) PCT Pub. No.: WO2015/154846
PCT Pub. Date: Oct. 15, 2015

(65) Prior Publication Data

US 2017/0030644 A1 Feb. 2, 2017

(30) Foreign Application Priority Data

Apr. 7, 2014 (EP) ..... 14290097

(51) Int. Cl.
*F26B 5/08* (2006.01)
*F26B 7/00* (2006.01)

(52) U.S. Cl.
CPC . *F26B 5/08* (2013.01); *F26B 7/00* (2013.01)

(58) Field of Classification Search
CPC .... F26B 5/08; F26B 7/00; F26B 11/02; F26B 11/04; F26B 3/00; F26B 3/02; B04B 15/02
(Continued)

(56) References Cited

U.S. PATENT DOCUMENTS 3,977,935 A * 8/1976 Kowarski ..... B01D 1/0082 159/23
4,391,710 A * 7/1983 Gordon ..... G01N 1/2813 210/361
(Continued)

FOREIGN PATENT DOCUMENTS

CN 201025422 Y 2/2008
CN 203464621 U 3/2014
(Continued)

OTHER PUBLICATIONS

Office Action for corresponding JP appln. 2016-561356 dispatched May 16, 2019 (pp. 1-2).
(Continued)

*Primary Examiner* — Edelmira Bosques
*Assistant Examiner* — Bao D Nguyen
(74) *Attorney, Agent, or Firm* — Millen, White, Zelano and Branigan, P.C.; Harry B. Shubin

(57) ABSTRACT

An apparatus (10; 20; 30; 40; 60) for removing moisture from a surface (522) in a container (500; 500$_1$, 500$_2$; 500'), characterized by: a centrifuging element comprising a mount (140; 140$_1$, 140$_2$) for attaching said container (500; 500$_1$, 500$_2$; 500') to said centrifuging element and a drive (105) coupled to said mount (140; 140$_1$, 140$_2$) for rotating said attached container (500; 500$_1$, 500$_2$; 500') and centrifuging said moisture off said surface (522) in said attached container (500; 500$_1$, 500$_2$; 500'); and a heating element (200) for providing heat energy and evaporating said moisture from said surface (522) in said attached container (500; 500$_1$, 500$_2$; 500'), and a corresponding method.

17 Claims, 8 Drawing Sheets

(58) Field of Classification Search
USPC ..... 34/315
See application file for complete search history.

(56) References Cited

U.S. PATENT DOCUMENTS

| | | | | |
|---|---|---|---|---|
| 5,234,667 | A * | 8/1993 | Radtke | B01L 3/5021 422/548 |
| 6,821,454 | B2 | 11/2004 | Visca et al. | |
| 2002/0066205 | A1 | 6/2002 | Visca et al. | |
| 2007/0245591 | A1* | 10/2007 | Gens | H01L 21/67034 34/443 |
| 2009/0107640 | A1* | 4/2009 | Lee-Smith | B04B 15/02 159/6.1 |
| 2009/0165326 | A1* | 7/2009 | Hedberg | B04B 15/08 34/312 |
| 2010/0012589 | A1* | 1/2010 | Ribault | B01L 3/502 210/650 |
| 2010/0043839 | A1* | 2/2010 | Hamada | C23F 1/18 134/30 |
| 2011/0277790 | A1 | 11/2011 | Hashimoto et al. | |

FOREIGN PATENT DOCUMENTS

| | | | | |
|---|---|---|---|---|
| DE | 10 2006 019642 | A1 | 11/2006 | |
| GB | 2 141 530 | A | 12/1984 | |
| GB | 2141530 | A * | 12/1984 | F26B 7/00 |
| JP | 2000180056 | A | 6/2000 | |
| JP | 2000-337768 | A | 12/2000 | |
| JP | 2000337768 | A * | 12/2000 | |
| JP | 2004066212 | A | 3/2004 | |
| JP | 2007005518 | A | 1/2007 | |
| JP | 2007-132550 | A | 5/2007 | |

OTHER PUBLICATIONS

International Search Report for PCT/EP2015/000594 dated Jun. 9, 2015.
English Abstract of DE102006019642, Publication Date: Nov. 2, 2006.
Office Action for related Chinese Patent Application No. 201580018790.9 dated Aug. 1, 2018.
English Abstract of CN201025422, Publication Date: Feb. 20, 2008.
English Abstract of CN203464621, Publication Date: Mar. 5, 2014.
Office Action in corresponding JP application 2016-561356 dated Jan. 16, 2020.

* cited by examiner

APPARATUS AND METHOD FOR REMOVING MOISTURE FROM A SURFACE IN A CONTAINER

FIELD OF THE INVENTION

Embodiments of the invention described herein relate generally to removing moisture such as droplets or mist of a liquid such as water, and more particularly to an apparatus and a method for removing the moisture from a surface in a container such as a Petri dish, test tube or PCR (polymerase chain reaction) tube.

BACKGROUND OF THE INVENTION

In life science, for example, optical analysis of a sample may be disturbed by moisture. Droplets and/or mist on a cover or lid of a PCR tube may prevent processing of the sample inside the PCR tube by a PCR cycler. Droplets on the cover may, for example, be removed by vibrations generating forces moving the droplets. The vibrations may originate from an ultrasound generator.

To some degree, droplets on the cover may be repelled by a hydrophobic coating.

While mist on the cover may be removed by a hydrophilic coating, droplets, that may form from the mist, are not removed.

US 2002/0066205 A1 discloses a method for removing water from surfaces of various materials, comprising the steps of covering said surface with a composition having specific weight higher than that of water and subsequently removing water from the composition by skimming, wherein a composition essentially consisting of the following components is used: a fluorinated non ionic additive component A) of formula: T-$OR_f$(CFY)-L (I) a (per)fluoropolyether component B), wherein the ratio by weight (K) between the (per)fluorinated part and the hydrogenated L part of the additive is in the range 1.50-4.00 and the ratio $K^I$ between the number average molecular weight of the fluoropolyether part T-$OR_f^-$ of the additive and the number average molecular weight of the component B) is higher than 1.60.

US 2011/0277790 A1 discloses a process for removing water from an article, which comprises using a fluorinated solvent containing an alcohol as a water removal solvent, bringing the water removal solvent in a dipping sump to a boiling state, condensing vapor of the water removal solvent at an upper portion of the dipping sump, removing the water from the condensed water removal solvent outside the dipping sump and then returning the water removal solvent to the dipping sump, dipping an article having water attached in the water removal solvent in a boiling state in the dipping sump to remove water and then withdrawing the article.

For these and other reasons, there is a need for the invention as set forth in the following embodiments.

SUMMARY OF THE INVENTION

The invention aims to provide an apparatus and a method for removing moisture from a surface in a container.

This object is solved by the subject matter of the independent claims. The subject matter utilizes the effect of centrifugal forces to reduce the size of moisture particles of a liquid on the surface and the effect of heat energy to evaporate these moisture particles. Through the combination of these effects, the necessary centrifugal forces are low and the necessary heat energy is low. The liquid may be a polar liquid such as water or a water-based liquid, or a non-polar liquid. The liquid may be a sample to be analysed or a solvent comprising the sample. Advantages of the subject matter comprise a reduced processing time, a low energy consumption, an absence of agents such as additives and a processing without contacting the surface and/or moisture particles thereon (contactless processing). The absence of agents ensures purity and immutability of the sample inside the container. Thus, the subject matter is harmless to a sample comprising a single cell or living microorganisms such as bacteria or germs. The contactless processing is suitable for a closed or sealed container such as a Petri dish, test tube or PCR tube, and, thus, prevents contamination of the sample contained therein. Thus, the subject matter is compatible with established processes in life science and other technical fields, and enables, among other things, optical analysis of the sample through a see-through window in the container itself or in a cover thereof.

According to an aspect of the invention, the apparatus is adapted to rotate said attached container at centrifugal acceleration of between 1 $m/s^2$ and 25000 $m/s^2$, for example between 10 $m/s^2$ and 10000 $m/s^2$ or between 10 $m/s^2$ and 5000 $m/s^2$, such as about 300 $m/s^2$. The centrifugal acceleration has an accordant effect on the resulting centrifugal force. As the centrifugal force increases, the size, i. e. diameter of the moisture particles on the surface decreases. Thus, as the centrifugal acceleration increases, effectiveness of moisture removal from the surface by centrifugation increases.

According to an aspect of the invention, the apparatus is adapted to rotate said attached container for a duration of between 1 s and 500 s, for example between 3 s and 300 s, such as between 10 s and 180 s, like about 120 s. According to an aspect of the invention, the apparatus is adapted to rotate said attached container at a centrifugal acceleration of about 300 $m/s^2$ for a duration of about 10 s. An application of the centrifugal acceleration of about 300 $m/s^2$ for the duration of about 10 s results in an effective moisture removal from the surface by centrifugation, that may be followed by moisture removal from the surface by evaporation, such that overall efficiency of that moisture removal from the surface may be increased.

According to an aspect of the invention, the apparatus is adapted to rotate said attached container at a first centrifugal acceleration of about 300 $m/s^2$ for a first duration of about 10 s and, thereafter, a second centrifugal acceleration of about 0 to 10 $m/s^2$, preferably 3 $m/s^2$, for a second duration of about 120 s. The application of two centrifugal accelerations for the two durations increases effectiveness of moisture removal from the surface by centrifugation further.

Another aspect of the invention is an apparatus, wherein said mount attaches said container such that said rotational axis passes through said container or a centre point of said container. In this configuration, the apparatus may be particularly space saving.

Another aspect of the invention is an apparatus, wherein said mount attaches said container such that said rotational axis does not pass through said container. In this configuration, the centrifugal force increases for a given rotational speed. Thus, the effectiveness of moisture removal from the surface by centrifugation increases further.

Another aspect of the invention is an apparatus, wherein said centrifuging element further comprises another drive coupled to said mount for rotating said attached container about another rotational axis and centrifuging said moisture off said surface in said attached container and said mount attaches said container such that said other rotational axis passes through said container or said centre point of said container. In this configuration, the two rotational movements are superimposed. The superimposition increases the centrifugal force further. Thus, the effectiveness of moisture removal from the surface by centrifugation increases further.

According to another aspect of the invention, the apparatus is adapted to provide said heat energy at a temperature of between 25° C. and 600° C., for example between 50° C. and 150° C., such as between 80° C. and 120° C., like about 100° C. Providing the heat energy at these temperatures results in an efficient moisture removal from the surface by evaporation and may prevent overheating of the content, for example a liquid, of the container and/or evaporation of the liquid in the container.

According to another aspect of the invention, the apparatus is adapted to provide said heat energy at a temperature of, at least, between 10 K and 20 K below a melting point of said container. Providing the heat energy at these temperatures prevents softening and/or melting of the container, while optimizing provision of heat energy and minimizing duration of moisture removal from the surface by evaporation. For example, the copolymer plastic styrene acrylonitrile (SAN, $(C_8H_8)_n$—$(C_3H_3N)_m$) comprising styrene and acrylonitrile has, owing to the acrylonitrile units in the chain, a glass transition temperature greater than 100° C.

According to another aspect of the invention, the apparatus is adapted to provide said heat energy for a duration of between 1 s and 500 s, for example between 3 s and 300 s, such as between 10 s and 180 s, like about 120 s. Providing the heat energy for these durations results in an efficient moisture removal from the surface by evaporation and may prevent overheating of the content of the container and/or evaporation of the liquid in the container.

According to another aspect of the invention, the apparatus is adapted to provide said heat energy using hot air or circulating hot air. Hot air may be easily produced and conveyed to the container. Moreover, by circulating the hot air energy may be used efficiently.

According to another aspect of the invention, the apparatus is adapted to provide said heat energy in direct contact to a window on a cover of said attached container, wherein said surface is situated on said window. As the heat energy is provided in direct contact, energy spread and/or energy loss are reduced.

According to another aspect of the invention, the apparatus is adapted to evaporate said moisture from said surface after centrifuging said moisture off said surface. By removing moisture from the surface by centrifugation and, subsequently, by evaporation, energy may be used more efficiently. According to another aspect of the invention, the apparatus is adapted to evaporate said moisture from said surface while centrifuging said moisture off said surface. By removing moisture from the surface concurrently by centrifugation and evaporation, efficiency may be increased and processing time may be reduced.

Another aspect of the invention is an apparatus or a container, wherein said surface is formed hydrophobic. The surface may be coated with a hydrophobic substance or its structure may be made hydrophobic. On a hydrophobic surface contact with the moisture particles of water or a water-based liquid is reduced. Thus, moisture removal from the surface by centrifugation is improved.

Another aspect of the invention is an apparatus or a container, wherein said surface is formed hydrophilic. The surface may be coated with a hydrophilic substance or its structure may be made hydrophilic. On a hydrophilic surface contact with the moisture particles of water or a water-based liquid is increased. As transfer of heat energy from the surface of the container to the moisture particles is improved, moisture removal from the surface by evaporation is improved.

Another aspect of the invention is a method, wherein said attached container is rotated at a centrifugal acceleration of between 1 $m/s^2$ and 25000 $m/s^2$, for example between 10 $m/s^2$ and 10000 $m/s^2$ or between 10 $m/s^2$ and 10000 $m/s^2$, such as about 300 $m/s^2$. The centrifugal acceleration has an accordant effect on the resulting centrifugal force. As the centrifugal force increases, the size, i. e. diameter of the moisture particles on the surface decreases. Thus, as the centrifugal speed increases, effectiveness of moisture removal from the surface by centrifugation increases.

Another aspect of the invention is a method, wherein said attached container is rotated for a duration of between 1 s and 500 s, for example between 3 s and 300 s, such as between 10 s and 180 s, like about 120 s. As the duration of centrifugation increases, effectiveness of moisture removal from the surface by centrifugation increases for a given centrifugal force.

Another aspect of the invention is a method, wherein said attached container is rotated at a centrifugal acceleration of about 300 $m/s^2$ for a duration of about 10 s. An application of the centrifugal acceleration of about 300 $m/s^2$ for the duration of about 10 s results in an effective moisture removal from the surface by centrifugation, that may be followed by moisture removal from the surface by evaporation, such that overall efficiency of that moisture removal from the surface may be increased. Another aspect of the invention is a method, wherein said attached container is rotated at a first centrifugal acceleration of about 300 $m/s^2$ for a first duration of about 10 s and, thereafter, a second centrifugal acceleration of about 0 to 10 $m/s^2$ for a second duration of about 120 s. The application of these two centrifugal accelerations for the two durations increases effectiveness of moisture removal from the surface by centrifugation further. Another aspect of the invention is a method, wherein said container is attached to said mount such that said rotational axis passes through said container or a centre point of said container. In this configuration, the method may be performed particularly space saving.

Another aspect of the invention is a method, wherein said container is attached to said mount such that said rotational axis does not pass through said container. In this configuration, the centrifugal force increases for a given rotational speed. Thus, the effectiveness of moisture removal from the surface by centrifugation increases further.

Another aspect of the invention is a method, wherein said centrifuging element further comprises another drive coupled to said mount for rotating said attached container about another rotational axis and centrifuging said moisture off said surface in said attached container and said container is attached to said mount such that said other rotational axis passes through said container or said centre point of said container. In this configuration, the two rotational movements are superimposed. The superimposition increases the centrifugal force further. Thus, the effectiveness of moisture removal from the surface by centrifugation increases further.

Another aspect of the invention is a method, wherein said heat energy is provided at a temperature of between 25° C. and 600° C., for example between 50° C. and 150° C., such as between 80° C. and 120° C., like about 100° C. Providing the heat energy at these temperatures results in an efficient moisture removal from the surface by evaporation and may prevent overheating of the content, for example a liquid, of the container and/or evaporation of the liquid in the container.

Another aspect of the invention is a method, wherein said heat energy is provided at a temperature of, at least, between 10 K and 20 K below a melting point of said container. Providing the heat energy at these temperatures prevents softening and/or melting of the container, while optimizing provision of heat energy and minimizing duration of moisture removal from the surface by evaporation.

Another aspect of the invention is a method, wherein said heat energy is provided for a duration of between 1 s and 500 s, for example between 3 s and 300 s, such as between 10 s and 180 s, like about 120 s. Providing the heat energy for these durations results in an efficient moisture removal from the surface by evaporation and may prevent overheating of the content of the container and/or evaporation of the liquid in the container.

Another aspect of the invention is a method, wherein said heat energy is provided using hot air, for example circulating hot air. Hot air may be easily produced and conveyed to the container. Moreover, by circulating the hot air energy may be used efficiently.

Another aspect of the invention is a method, wherein said heat energy is provided in direct contact to a window on a cover of said attached container, and said surface is situated on said window. As the heat energy is provided in direct contact, energy spread and/or energy loss are reduced.

Another aspect of the invention is a method, wherein said moisture is evaporated from said surface after said moisture is centrifuged off said surface. By removing moisture from the surface by centrifugation and, subsequently, by evaporation, energy may be used more efficiently. Another aspect of the invention is a method, wherein said moisture is evaporated from said surface while said moisture is centrifuged off said surface. By removing moisture from the surface concurrently by centrifugation and evaporation, efficiency may be increased and processing time may be reduced.

Another aspect of the invention is a method, wherein said surface is formed hydrophobic. The surface may be coated with a hydrophobic substance or its structure may be made hydrophobic. On a hydrophobic surface contact with the moisture particles of water or a water-based liquid is reduced. Thus, moisture removal from the surface by centrifugation is improved. Another aspect of the invention is a method, wherein said surface is formed hydrophilic. The surface may be coated with a hydrophilic substance or its structure may be made hydrophilic. On a hydrophilic surface contact with the moisture particles of water or a water-based liquid is increased. As transfer of heat energy from the surface of the container to the moisture particles is improved, moisture removal from the surface by evaporation is improved.

All of the above aspects may be combined and each aspect may include one or more features mentioned in connection with any of the other aspects.

BRIEF DESCRIPTION OF FIGURES

While the specification concludes with claims particularly pointing out and distinctly claiming that which is regarded as the invention, a more particular description of the invention will be rendered by reference to specific embodiments thereof, which are depicted in the appended drawing, in order to illustrate the manner in which embodiments of the invention are obtained. Understanding that the drawing depicts only typical embodiments of the invention, that are not necessarily drawn to scale, and, therefore, are not to be considered limiting of its scope, embodiments will be described and explained with additional specificity and detail through use of the accompanying drawing in which:

DETAILED DESCRIPTION OF THE INVENTION

Figure 1:
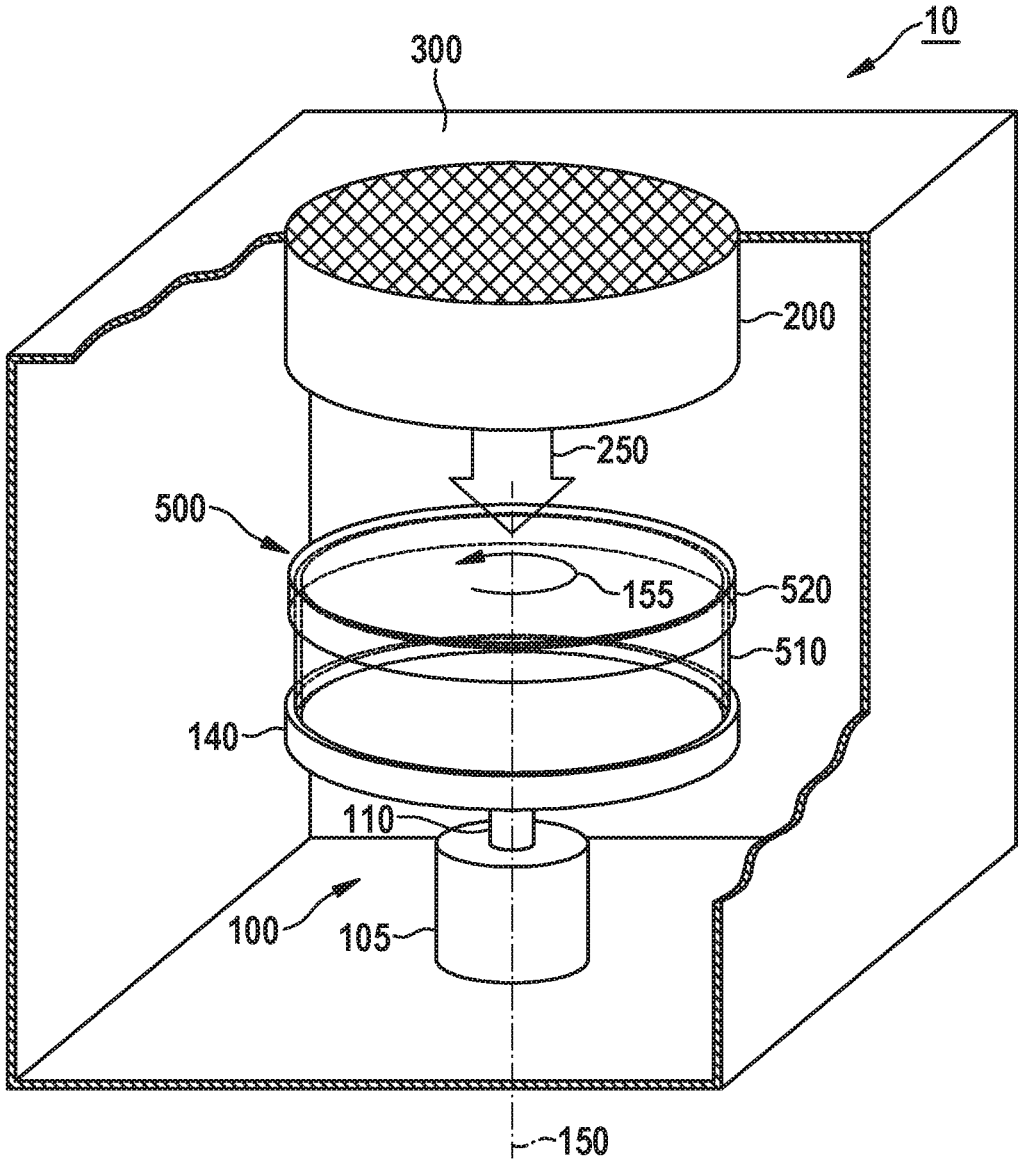
FIG. 1 shows a perspective view of an apparatus 10 for removing moisture from a surface in a container 500 according to an embodiment of the invention.

In the detailed description of the embodiments, reference is made to the accompanying drawing which forms a part hereof and shows, by way of illustration, specific embodiments in which the invention may be practiced. In order to show the structures of the embodiments most clearly, the drawing included herein is a diagrammatic representation of inventive articles. Thus, actual appearance of the fabricated structures may appear different while still incorporating essential structures of embodiments. Moreover, the drawing shows only the structures necessary to understand the embodiments. Additional structures known in the art have not been included to maintain clarity of the drawings. It is also to be understood, that features and/or elements depicted herein are illustrated with particular dimensions relative to one another for purposes of simplicity and ease of understanding, and that actual dimensions may differ substantially from that illustrated herein. In the drawing, like numerals describe substantially similar components throughout the several views. The embodiments are intended to describe aspects of the invention in sufficient detail to enable those of skill in the art to practice the invention. Other embodiments may be utilized and structural, logical or electrical changes or combinations thereof may be made without departing from the scope of the invention.

Moreover, it is to be understood, that the various embodiments of the invention, although different, are not necessarily mutually exclusive. For example, a particular element, feature, structure, characteristic, integer or step, or group of elements, features, structures, characteristics, integers or steps described in one embodiment may be included within other embodiments. Furthermore, it is to be understood, that embodiments of the invention may be implemented using different technologies. Also, the term "exemplary" is merely meant as an example, rather than the best or optimal. The detailed description is, therefore, not to be taken in a limiting sense.

Throughout this specification the word "comprise" or variations such as "comprises" or "comprising", will be understood to imply the inclusion of a stated element, integer or step, or group of elements, integers or steps, but not the exclusion of any other element, integer or step, or group of elements, integers or steps.

In the description and claims, the terms "include", "have", "with" or other variants thereof may be used. It is to be understood, that such terms are intended to be inclusive in a manner similar to the term "comprise".

In the description and claims, the terms "coupled" and "connected", along with derivatives such as "communicatively coupled" may be used. It is to be understood, that these terms are not intended as synonyms for each other. Rather, in particular embodiments, "connected" may be used to indicate, that two or more elements are in direct physical or electrical contact with each other.

However, "coupled" may also mean that two or more elements are not in direct contact with each other, but yet still co-operate or interact with each other.

In the description and claims, terms, such as "upper", "lower", "first", "second", etc., may be only used for descriptive purposes and are not to be construed as limiting. The embodiments of a device or article described herein can be manufactured, used, or shipped in a number of positions and orientations.

FIG. 1 shows a perspective view of an apparatus 10 for removing moisture from a surface in a container 500 according to an embodiment of the invention.

The container 500 may, as exemplified in FIG. 1, be a Petri dish comprising a dish 510 and a lid 520. The lid 520 may be attached, for example clamped, locked or stuck, to the dish 510. The container 500 may have a see-through window that may be situated on the lid 520. The window may have a surface inside the container 500. The container 500 may have a diameter of 50 mm, for example. The container 500 may further comprise a layer or membrane for growing microorganisms such as bacteria, yeast or molds. The container 500 comprises a liquid such as water or culture medium. The liquid may form moisture such as droplets and mist inside the container 500. The moisture may cover the (inner) surface of the see-through window.

The apparatus 10 comprises a centrifuging element 100 for rotating the container 500 about a rotational axis 150 and a heating element 200 for providing heat energy to the container 500. As exemplified in FIG. 1, the centrifuging element 100 may be arranged, with reference to a normal working position of the apparatus 10, towards a bottom of the apparatus 10, and the heating element 200 may be arranged above the centrifuging element 100 towards a top of the apparatus 10. The centrifuging element 100 comprises a drive 105 such as an electrical motor and a mount 140 such as a clamp for attaching the container 500 to the centrifuging element 100. The mount 140 may be coupled to drive 105 via a shaft 110. The mount 140 may attach the container 500 concentrically to the rotational axis 150. Alternatively, the mount 140 may attach the container 500 eccentrically to the rotational axis 150. As shown in FIG. 1, the mount 140 may attach to the dish 510, and the lid 520 may face towards the top of the apparatus 10. The drive 105 may rotate the container 500 in a counter-clockwise direction 155 or clockwise direction. The heating element 200 may comprise a heating such as an electrical heating (e.g. heat resistance) and a blower or fan. The heating may generate a stream 250 of hot air directed to the lid 520, more particularly the window situated on the lid 520. In another embodiment, a heating element (e.g. heat resistance) is placed close enough to the windows to heat the window by heat conduction in the air. In a further embodiment, the heating element (e.g. heat resistance) is in direct contact to the window. The apparatus 10 may further comprise a housing 300 wherein the centrifuging element 100 and the heating element 200 may be situated. For removing any droplets and/or mist from the (inner) surface of the window prior to an optical analysis of the content of the container 500 through the window, the drive 105 rotates the container 500 about the rotational axis 150 for centrifuging the droplets off the (inner) surface of the window, and, subsequently, the heating element 200 blows the stream 250 of hot air onto the window for evaporating any remaining droplets and mist from the (inner) surface of the window. In another embodiment, a heating element (e.g. heat resistance) is placed close enough to the windows to heat the window by heat conduction in the air. In a further embodiment, the heating element (e.g. heat resistance) is in direct contact to the window. According to T. Tate's Law, a droplet of a specific fluid hanging on the bottom of a tube is falling from the tube in a vertical direction when the volume of the droplet reaches the maximum value, which depends on the characteristic, for example surface tension, of the fluid:

$$mg=2\pi r\sigma \tag{1}$$

where m is the mass of the droplet, g is the Earth's standard acceleration owing to gravity, r is the radius of the droplet, and σ is the surface tension of the fluid. In other words, the droplet begins to fall when the weight of the droplet m g is equal to the circumference 2πr of the droplet multiplied by the surface tension σ.

Similarly, a droplet may be centrifuged off a surface when the centrifugal force exceeds the surface tension:

$$ma=mng=4/3\pi r3\rho ng=2\pi r\sigma \tag{2}$$

where m is the mass of the droplet, a is the acceleration effecting the droplet, g is the Earth's standard acceleration owing to gravity, n is a factor expressing the acceleration a in multiples of Earth's standard acceleration, r is the radius of the droplet, σ is the surface tension of the fluid, and ρ is the density of the fluid.

Thus, the higher the centrifugal force, the smaller the size of droplets remaining on the surface:

$$r=\sqrt{(3\sigma/(2\rho ng))} \tag{3}$$

The drive 105 may rotate the container 500 at a centrifugal acceleration of about 300 $m/s^2$ for a duration of about 10 s. The heating element 200 may blow the stream 250 of hot air (or heat the air in-between the window and the heating element or heat the window directly) at a temperature of between 100° C. and 110° C. for a duration of about 60 s.

The content of the container 500 may be analysed in the apparatus 10 or elsewhere.

Figure 2:
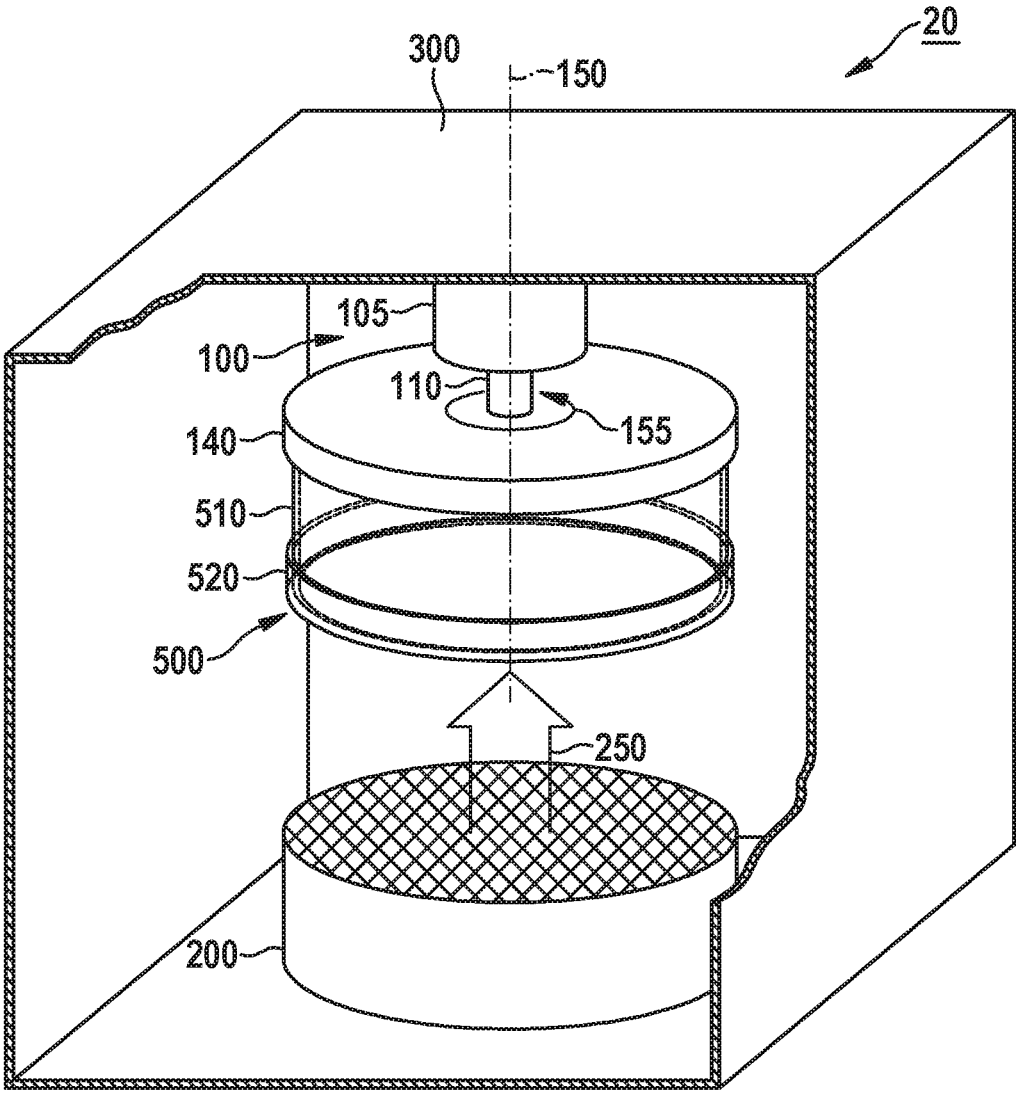
FIG. 2 shows a perspective view of an apparatus 20 for removing moisture from a surface in a container 500 according to another embodiment of the invention.

FIG. 2 shows a perspective view of an apparatus 20 for removing moisture from a surface in a container 500 according to another embodiment of the invention.

As already described with reference to FIG. 1, the apparatus 20 comprises a centrifuging element 100 for rotating the container 500 about a rotational axis 150 and a heating element 200 for providing heat energy to the container 500. However, as shown in FIG. 2, the centrifuging element 100 may be arranged, with reference to the normal working position of the apparatus 20, towards the top of the apparatus 20, and the heating element 200 may be arranged below the centrifuging element 100 towards the bottom of the apparatus 20. The centrifuging element 100 comprises the drive 105 and the mount 140 for attaching the container 500 to the centrifuging element 100. The mount 140 can hold or can be the heating element 200. The mount 140 may be coupled to drive 105 via the shaft 110. The mount 140 may attach the container 500 concentrically to the rotational axis 150. As shown in FIG. 2, the mount 140 may attach to the dish 510, and the lid 520 may face up-side down towards the bottom of the apparatus 20. The drive 105 may rotate the container 500 in a counter-clockwise direction 155 or clockwise direction. The heating may generate a stream 250 of hot air directed to the lid 520, more particularly the window situated on the lid 520. Alternatively, the heating may generate hot air between the heater element and the lid or be in direct contact with the lid, more particularly the window situated on the lid 520. When the lid 520 faces towards the bottom of the apparatus 20, the liquid cannot collect on a membrane or on the culture medium in the dish 510.

The apparatus 20 may further comprise a housing 300 wherein the centrifuging element 100 and the heating element 200 may be situated.

Figure 3:
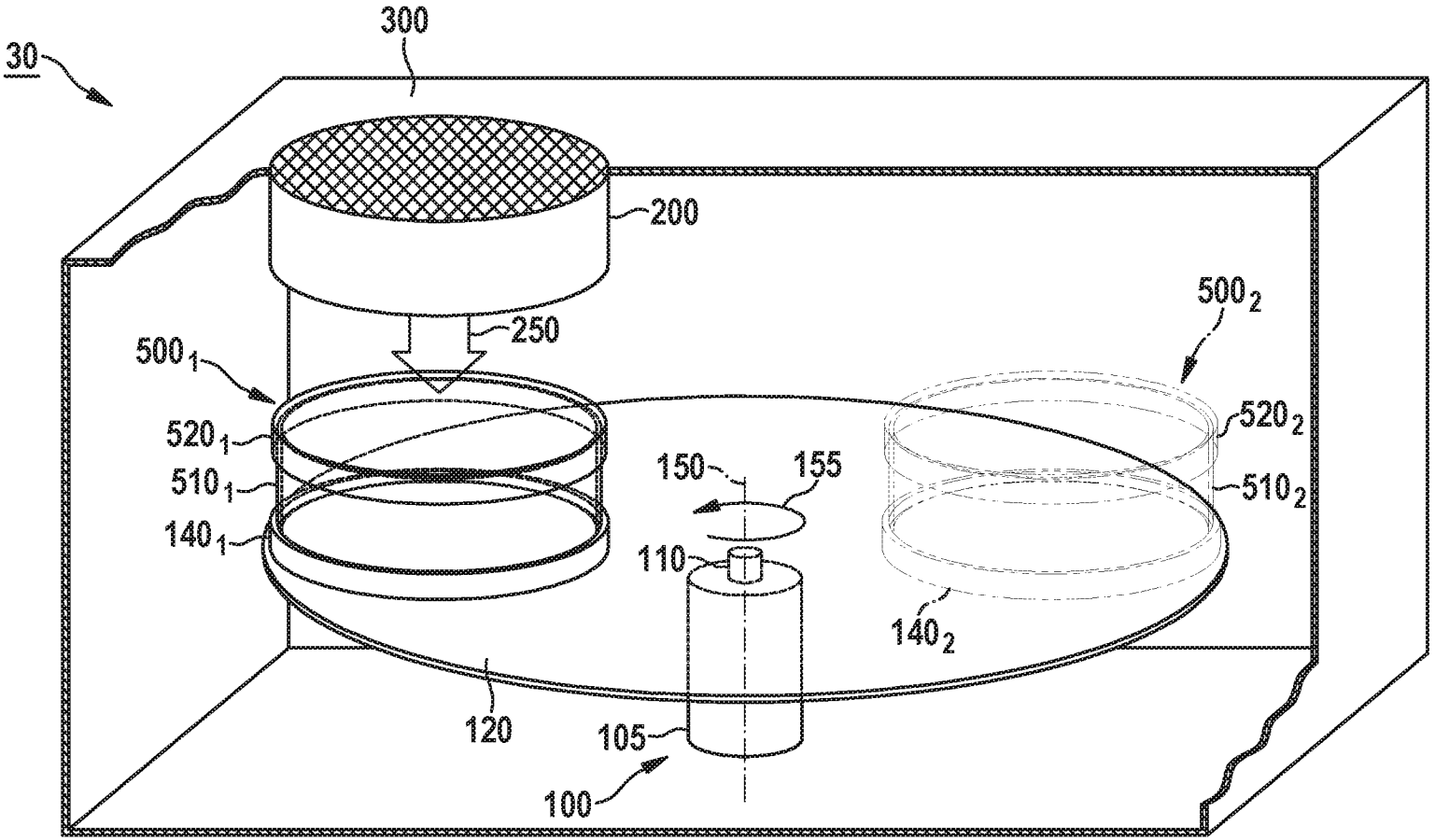
FIG. 3 shows a perspective view of an apparatus 30 for removing moisture from a surface in a container $\mathbf{500}_1$ according to a modified embodiment of the invention.

FIG. 3 shows a perspective view of an apparatus 30 for removing moisture from a surface in a container $\mathbf{500}_1$ according to a modified embodiment of the invention. As already described with reference to FIG. 1, the apparatus 30 comprises a centrifuging element 100 for rotating the container $\mathbf{500}_1$ about a rotational axis 150 and a heating element 200 for providing heat energy to the container $\mathbf{500}_1$. As shown in FIG. 3, the centrifuging element 100 may be arranged, with reference to the normal working position of the apparatus 30, towards the bottom of the apparatus 30, and the heating element 200 may be arranged above the centrifuging element 100 towards the top of the apparatus 30. The centrifuging element 100 comprises the drive 105 and the mount $\mathbf{140}_1$ for attaching the container $\mathbf{500}_1$ to the centrifuging element 100. The mount $\mathbf{140}_1$ may be coupled to drive 105 via a disk 120 such as a rotary disk and the shaft 110. Thus, the container $\mathbf{500}_1$ may be attached eccentrically to the rotational axis 150. The drive 105 may rotate the container $\mathbf{500}_1$ in a counter-clockwise direction 155 or clockwise direction. A single off-centre container $\mathbf{500}_1$ may result in an imbalance, that is generally undesirable. Thus, as shown in FIG. 3, another mount $\mathbf{140}_2$ may be situated on the disk 120 directly opposite to the mount $\mathbf{140}_1$ for attaching another container $\mathbf{500}_2$ to the centrifuging element 100. Alternatively, a counterweight may be attached to the disk 120 directly opposite to the mount $\mathbf{140}_1$. The heating or heatings may generate a stream 250 of hot air directed to the lid $\mathbf{520}_1$ or lids $\mathbf{520}_1$, $\mathbf{520}_2$ more particularly the window or windows situated on the lid $\mathbf{520}_1$ or lids $\mathbf{520}_1$, $\mathbf{520}_2$, of the container $\mathbf{500}_1$ or containers $\mathbf{500}_1$, $\mathbf{500}_2$.

The apparatus 30 may further comprise a housing 300 wherein the centrifuging element 100 and the heating element 200 may be situated.

In an alternative embodiment, the apparatus 30 shown in FIG. 3 is built in a mirror-inverted configuration with regard to a horizontal axis.

Figure 4:
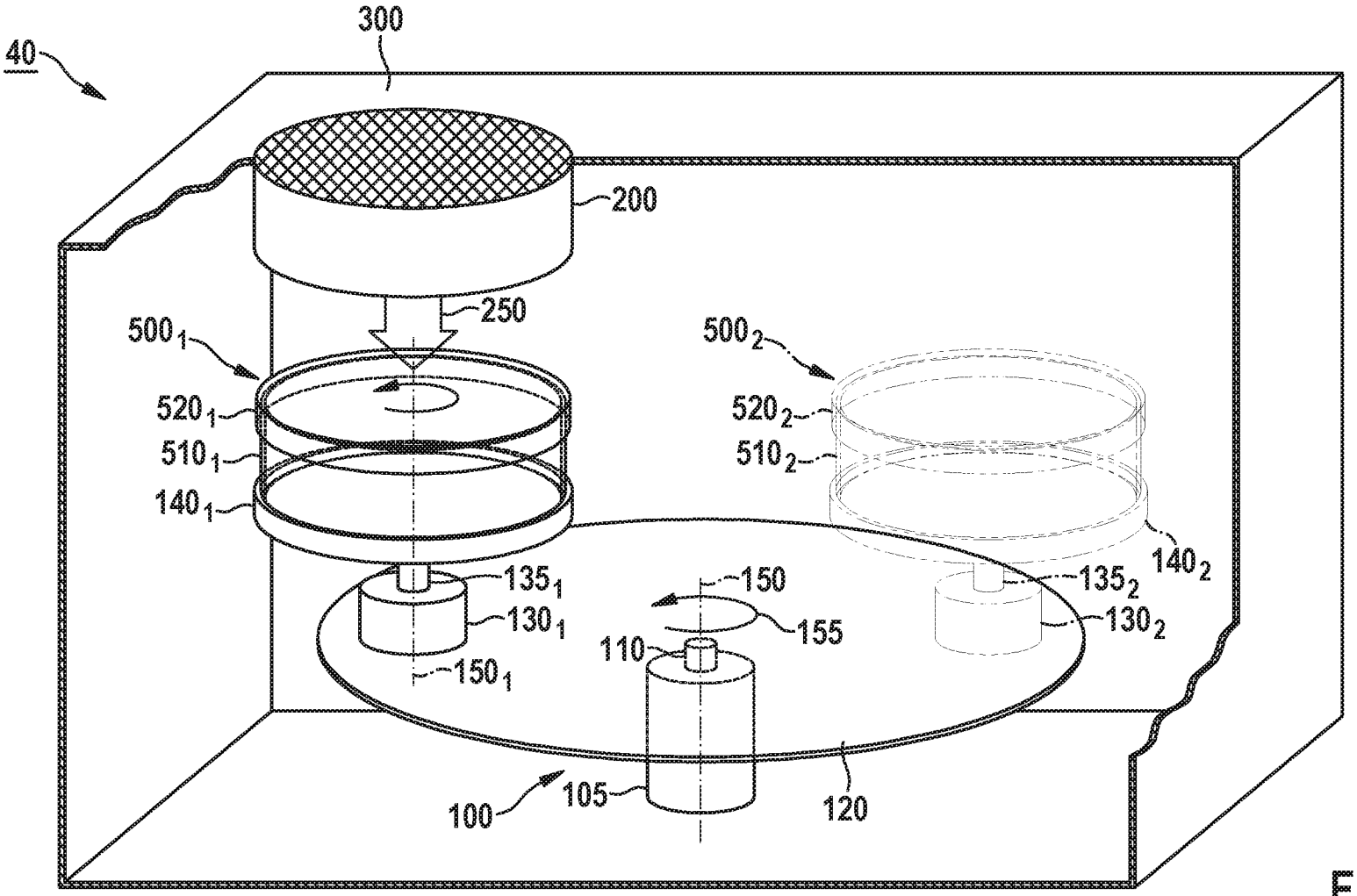
FIG. 4 shows a perspective view of an apparatus 40 for removing moisture from a surface in a container $\mathbf{500}_1$ according to another modified embodiment of the invention.

FIG. 4 shows a perspective view of an apparatus 40 for removing moisture from a surface in a container $\mathbf{500}_1$ according to another modified embodiment of the invention.

As already described with reference to FIG. 3, the apparatus 40 comprises a centrifuging element 100 for rotating the container $\mathbf{500}_1$ about a rotational axis 150 and a heating element 200 for providing heat energy to the container $\mathbf{500}_1$, and the centrifuging element 100 may be arranged towards the bottom of the apparatus 40, and the heating element 200 may be arranged above the centrifuging element 100 towards the top of the apparatus 40. The centrifuging element 100 comprises the drive 105, the disk 120 and the mount $\mathbf{140}_1$ for attaching the container $\mathbf{500}_1$ to the centrifuging element 100. The mount $\mathbf{140}_1$ may be coupled to drive 105 via another shaft $\mathbf{135}_1$, another drive $\mathbf{130}_1$, the disk 120 and the shaft 110. Thus, the container $\mathbf{500}_1$ may be attached concentrically to another rotational axis $\mathbf{150}_1$ that is itself rotatable around the rotational axis 150. The drive 105 may rotate the disk 120 in a counter-clockwise direction 155 or clockwise direction, and the drive $\mathbf{130}_1$ may rotate the container $\mathbf{500}_1$ in a counter-clockwise direction $\mathbf{155}_1$ or clockwise direction. The superimposition increases the centrifugal force. As a single off-centre container $\mathbf{500}_1$ may result in an imbalance, another mount $\mathbf{140}_2$, another drive $\mathbf{130}_2$ and another shaft $\mathbf{135}_2$ may be situated on the disk 120 directly opposite to the mount $\mathbf{140}_1$, drive $\mathbf{130}_1$ and shaft $\mathbf{135}_1$ for attaching another container $\mathbf{500}_2$ to the centrifuging element 100. Alternatively, a counterweight may be attached to the disk 120 directly opposite to the mount $\mathbf{140}_1$. The heating may generate a stream 250 of hot air directed to the lid $\mathbf{520}_1$ or lids $\mathbf{520}_1$, $\mathbf{520}_2$ more particularly the window or windows situated on the lid $\mathbf{520}_1$ or lids $\mathbf{520}_1$, $\mathbf{520}_2$, of the container $\mathbf{500}_1$ or containers $\mathbf{500}_1$, $\mathbf{500}_2$. Alternatively, the heating may generate hot air between the heater and the lid or the lids or be in direct contact with the lid or the lids.

The apparatus 40 may further comprise a housing 300 wherein the centrifuging element 100 and the heating element 200 may be situated.

Figure 5:
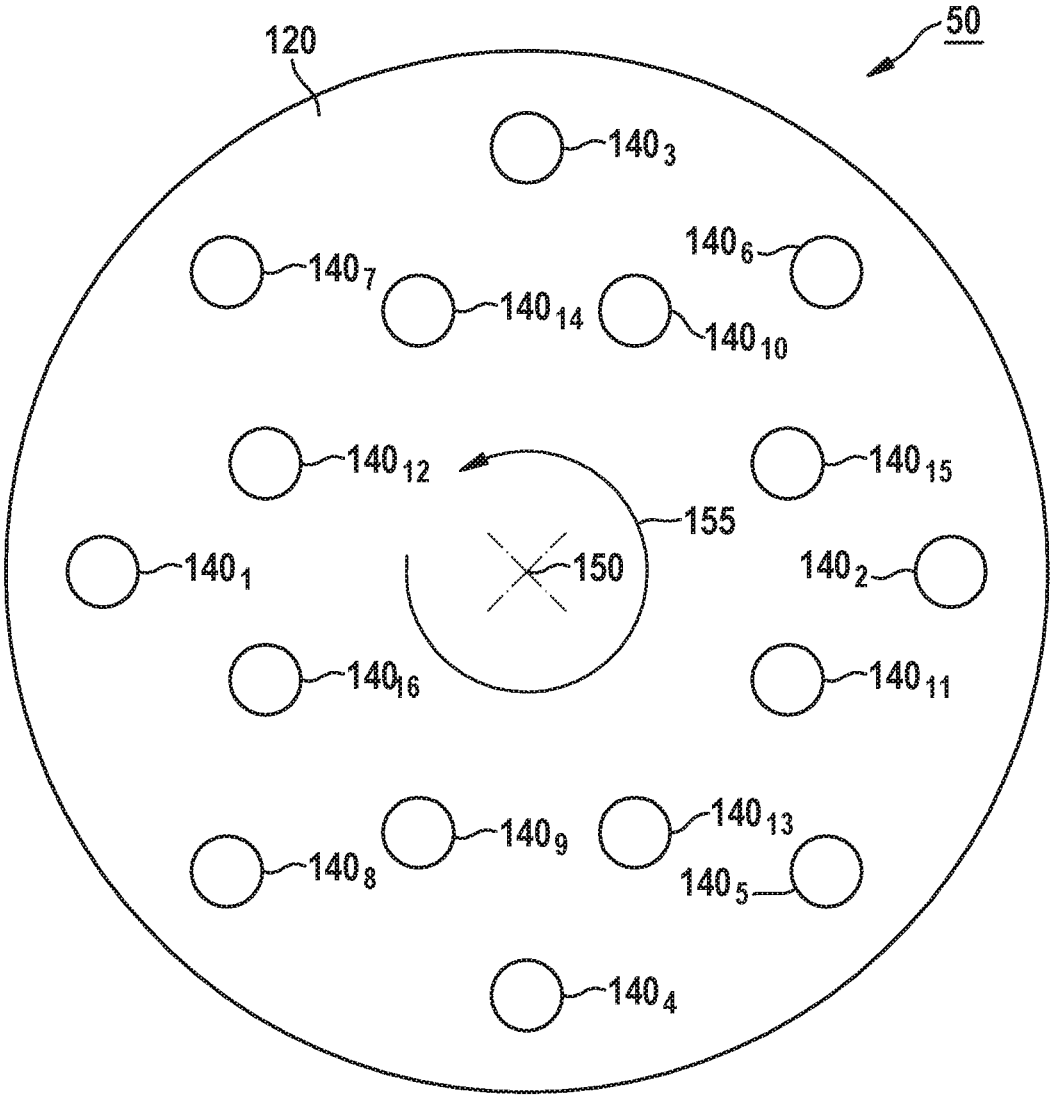
FIG. 5 shows a schematic top view for arrangements of 2, 4, 8 and 16 containers in an apparatus for removing moisture from surfaces in the containers.

FIG. 5 shows a schematic top view for arrangements of 2, 4, 8 and 16 containers in an apparatus for removing moisture from surfaces in the containers.

In order to increase throughput of the apparatus for removing moisture from a surface in a container, a plurality, for example an even number such as 2, 4, 8 or 16, of containers may be situated on and/or attached to the disk 120.

With reference to FIG. 5, two containers may be attached to mounts $\mathbf{140}_1$-$\mathbf{140}_2$, four containers may be attached to mounts $\mathbf{140}_1$-$\mathbf{140}_4$, eight containers may be attached to mounts $\mathbf{140}_1$-$\mathbf{140}_8$, twelve containers may be attached to mounts $\mathbf{140}_1$-$\mathbf{140}_{12}$, and 16 containers may be attached to mounts $\mathbf{140}_1$-$\mathbf{140}_{16}$.

Similarly, an odd number such as 3 or 5 of containers may be evenly spaced apart from each other around the circumference of the disk 120, for example at angles of 120° or 72°, respectively, and attached to the disk 120.

Figure 6:
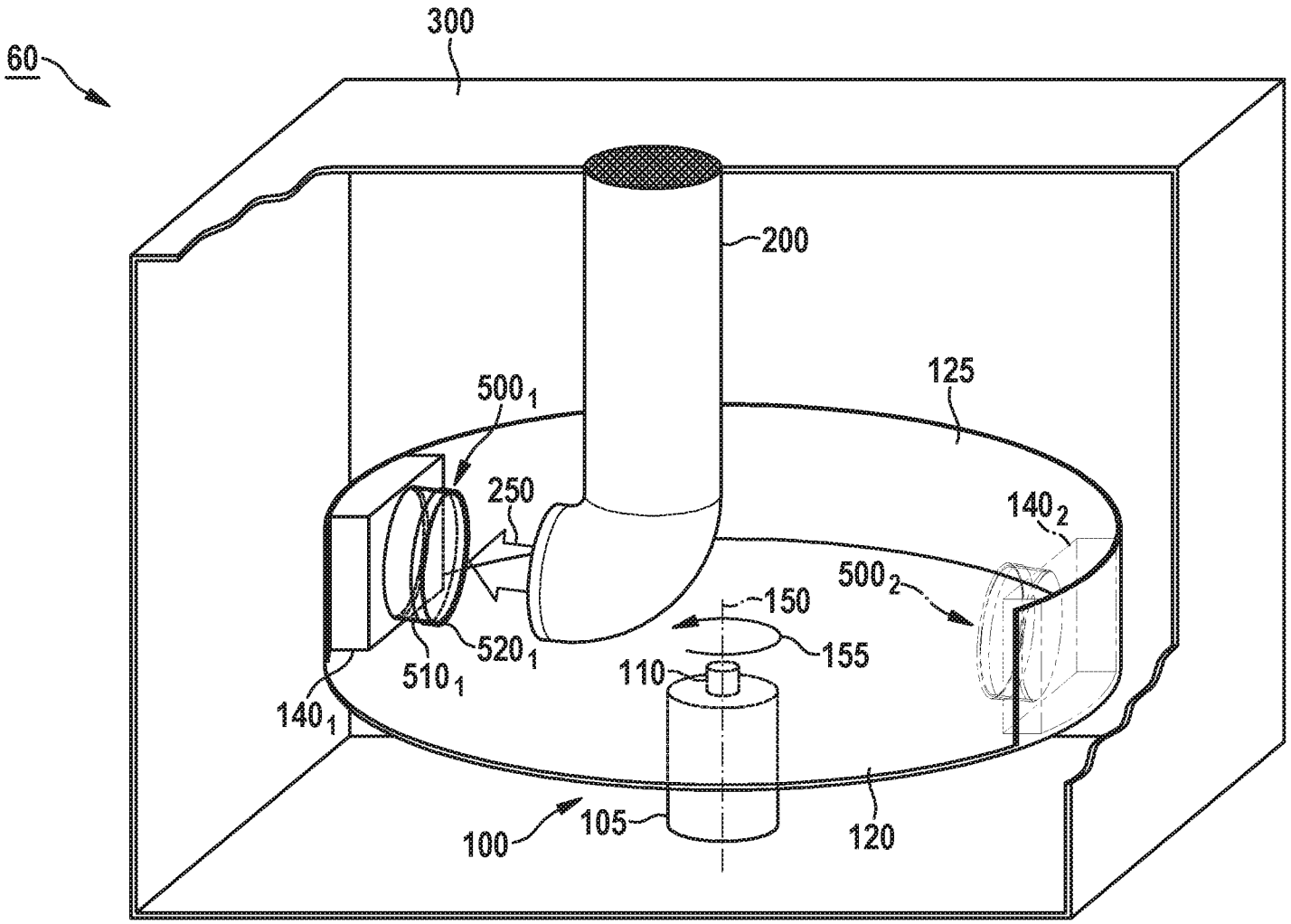
FIG. 6 shows a perspective view of an apparatus 60 for removing moisture from a surface in a container $\mathbf{500}_1$ according to an alternative embodiment of the invention.

FIG. 6 shows a perspective view of an apparatus 60 for removing moisture from a surface in a container $\mathbf{500}_1$ according to an alternative embodiment of the invention.

As already described with reference to FIG. 3, the apparatus 60 comprises a centrifuging element 100 for rotating the container $\mathbf{500}_1$ about a rotational axis 150 and a heating element 200 for providing heat energy to the container $\mathbf{500}_1$. As shown in FIG. 6, the centrifuging element 100 may be arranged, with reference to the normal working position of the apparatus 60, towards the bottom of the apparatus 60, and the heating element 200 may be arranged above, and extending into, the centrifuging element 100 towards the top of the apparatus 30. The centrifuging element 100 comprises the drive 105, the shaft 110, the disk 120 comprising a circumferential wall 125 and the mount $\mathbf{140}_1$ for attaching the container $\mathbf{500}_1$ to the centrifuging element 100. Thus, the disk 120 and the wall 125 form a drum. The mount $\mathbf{140}_1$ may be coupled to drive 105 via the wall 125, the disk 120 and the shaft 110. Thus, the container $\mathbf{500}_1$ may be attached vertically to the mount $\mathbf{140}_1$ on the wall 125 and eccentrically to the rotational axis 150. The drive 105 may rotate the container $\mathbf{500}_1$ in a counter-clockwise direction 155 or clockwise direction. As a single off-centre container $\mathbf{500}_1$ may result in an imbalance, another mount $\mathbf{140}_2$ may be situated on the wall 125 directly opposite to the mount $\mathbf{140}_1$ for attaching another container $\mathbf{500}_2$ to the centrifuging element 100. Alternatively, a counterweight may be attached to the wall 125 directly opposite to the mount $\mathbf{140}_1$. The heating or heatings may generate a stream 250 of hot air directed to the lid $\mathbf{520}_1$ or lids $\mathbf{520}_1$, $\mathbf{520}_2$ more particularly the window or windows situated on the lid $\mathbf{520}_1$ or lids $\mathbf{520}_1$, $\mathbf{520}_2$, of the container $\mathbf{500}_1$ or containers $\mathbf{500}_1$, $\mathbf{500}_2$. Alternatively, the heating may generate hot air between the heater and the lid or the lids or be in direct contact with the lid or the lids, more particularly the window or windows situated on the lid $\mathbf{520}_1$ or lids $\mathbf{520}_1$, $\mathbf{520}_2$, of the container $\mathbf{500}_1$ or containers $\mathbf{500}_1$, $\mathbf{500}_2$.

The apparatus 30 may further comprise a housing 300 wherein the centrifuging element 100 and the heating element 200 may be situated.

Figure 7:
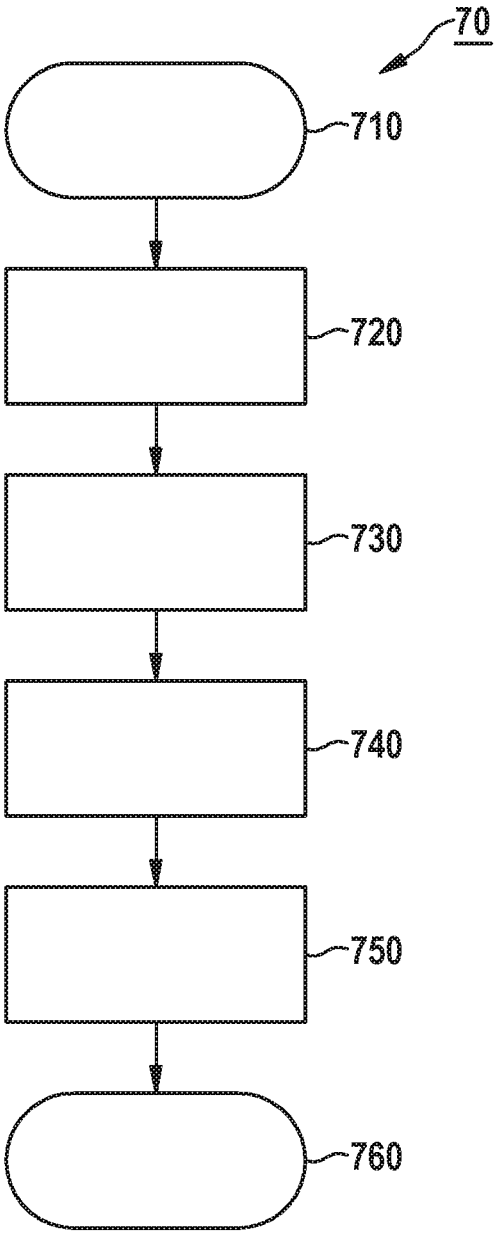
FIG. 7 shows a simplified flow chart 70 of a method for removing moisture from a surface in a container according to an embodiment of the invention.

FIG. 7 shows a simplified flow chart 70 of a method for removing moisture from a surface in a container according to an embodiment of the invention. The method for removing moisture from a surface in a container begins at step 710.

The method for removing moisture from a surface in a container may comprise, at step 720, eccentrically rotating the container at a centrifugal acceleration of 300 rpm for a duration of 10 s.

The method for removing moisture from a surface in a container may further comprise, at step 730, eccentrically rotating the container at another centrifugal acceleration of 0 to 10 $m/s^2$ for a duration of 120 s.

The method for removing moisture from a surface in a container may further comprise, at step 740, providing heat energy using hot air at a temperature of between 100° C. and 110° C. for a duration of 60 s. This step can also be done in parallel to the second centrifugal acceleration step of 0 to 10 $m/s^2$.

The method for removing moisture from a surface in a container terminates at step 760.

Figure 8:
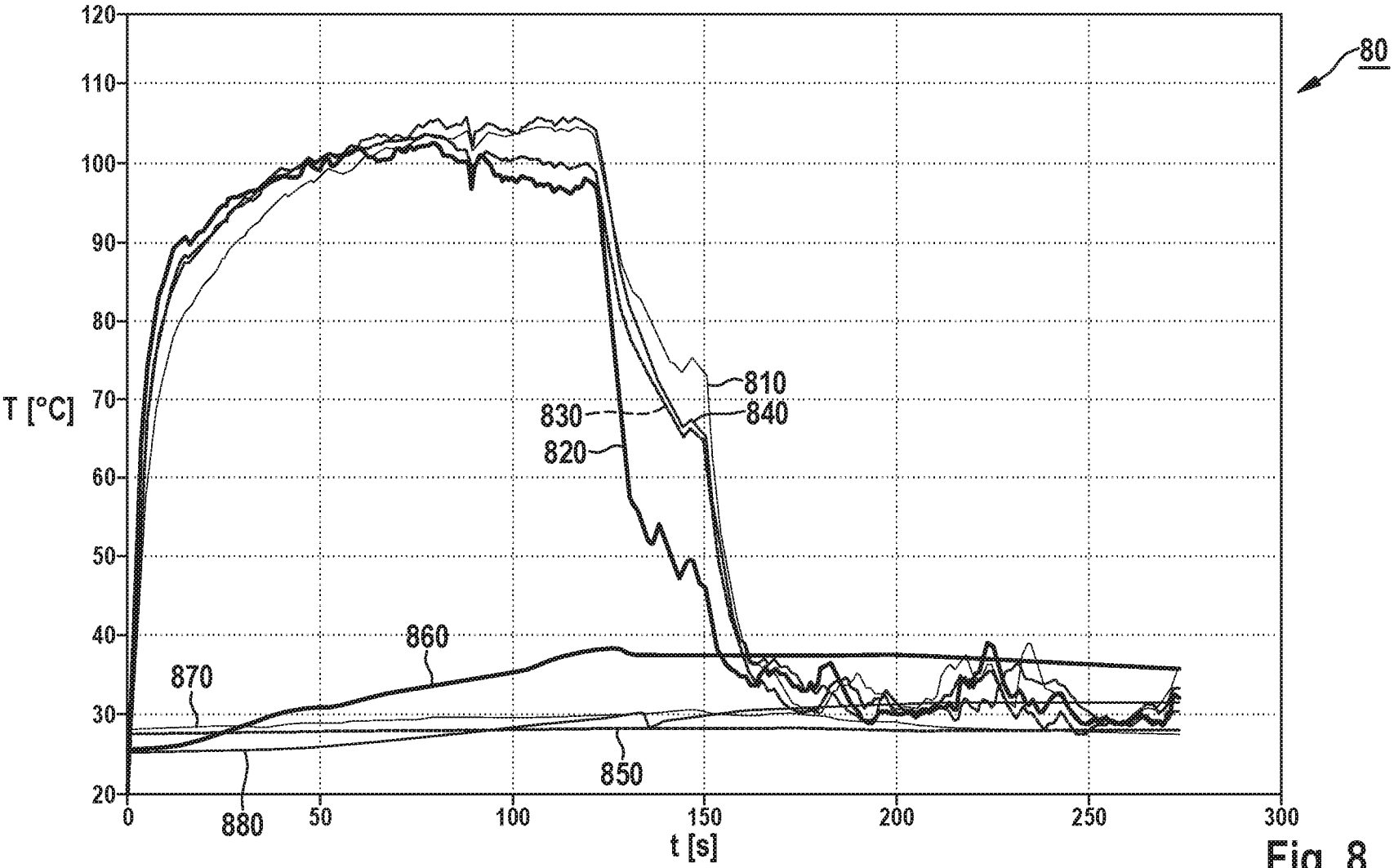
FIG. 8 shows exemplary temperatures at and in a container over time during removal of moisture from a surface in the container according to an embodiment of the invention.

FIG. 8 shows exemplary temperatures at and in a container over time during removal of moisture from a surface in the container according to an embodiment of the invention.

Hot air at a temperature of between 100° C. and 110° C. is applied to the container for a duration of 120 s, and the temperatures are measured for a duration of 270 s.

At positions 810, 820, 830, 840 outside the container, the temperature rise during application of the hot air nearly to the temperature of the hot air. After application of the hot air, the temperatures at the positions 810, 820, 830, 840 tail off.

At a position 850 at the base of the container, the temperature rises from about 25° C. to about 30° C. during the duration of 270 s.

At a position 860 inside the container, the air temperature rises from about 25° C. to about 35° C., but slowly decreases after application of the hot air, during the duration of 270 s.

At a position 870 at the bottom of the lid, the temperature swiftly rises to about 30° C. during the duration of 270 s.

At a position 880 at the medium in the container, the temperature rises from about 25° C. to about 30° C. during the duration of 270 s.

Even after application of hot air at a temperature of between 100° C. and 110° C. for a duration of 120 s, the temperatures at and in the container do not exceed 37° C. Moreover, the temperatures drop quickly to room temperature after stopping application of hot air. Thus, the method is harmless to samples comprising single cells and/or living microorganisms. Although specific embodiments have been illustrated and described herein, it will be appreciated by those of ordinary skill in the art, that any arrangement which is calculated to achieve the same purpose may be substituted for the specific embodiments shown. It is to be understood, that the above description is intended to be illustrative and not restrictive. This application is intended to cover any adaptations or variations of the invention. Combinations of the above embodiments and many other embodiments will be apparent to those of skill in the art upon reading and understanding the above description. The scope of the invention includes any other embodiments and applications in which the above structures and methods may be used. The scope of the invention is, therefore, defined only by the appended claims, along with the full scope of equivalents to which such claims are entitled.

The invention claimed is:

1. An apparatus (10; 20; 30; 40; 60) for removing moisture from a surface (522) of a closed or sealed container containing a sample to be analyzed (500; $\mathbf{500}_1$, $\mathbf{500}_2$; 500'), comprising the closed or sealed container containing the sample to be analyzed (500; $\mathbf{500}_1$, $\mathbf{500}_2$; 500'):

a centrifuge comprising a mount (140; 1401, 1402) attaching said closed or sealed container containing the sample to be analyzed (500; $\mathbf{500}_1$, $\mathbf{500}_2$; 500') to said centrifuge and a drive (105) coupled to said mount (140; 1401, 1402) rotating said attached closed or sealed container containing the sample to be analyzed (500; $\mathbf{500}_1$, $\mathbf{500}_2$; 500') about a rotational axis (150) and centrifuging said moisture off said surface (522) in said attached closed or sealed container containing the sample to be analyzed (500; $\mathbf{500}_1$, $\mathbf{500}_2$; 500'); and a heat source (200) providing heat energy and evaporating said moisture from said surface (522) in said attached closed or sealed container containing the sample to be analyzed (500; $\mathbf{500}_1$, $\mathbf{500}_2$; 500').

2. The apparatus (10; 20; 30; 40; 60) of claim 1, adapted to:

rotate said attached closed or sealed container containing the sample to be analyzed (500; $\mathbf{500}_1$, $\mathbf{500}_2$; 500') at a centrifugal acceleration of 1 $m/s^2$ to 25000 $m/s^2$, rotate said attached closed or sealed container containing the sample to be analyzed (500; $\mathbf{500}_1$, $\mathbf{500}_2$; 500') for a duration of 1 s to 500 s, rotate said attached closed or sealed container containing the sample to be analyzed (500; $\mathbf{500}_1$, $\mathbf{500}_2$; 500') at a centrifugal acceleration of 300 $m/s^2$ for a duration of 10 s, or rotate said attached closed or sealed container containing the sample to be analyzed (500; $\mathbf{500}_1$, $\mathbf{500}_2$; 500') at a first centrifugal acceleration of 300 $m/s^2$ for a first duration of 10 s and, thereafter, a second centrifugal acceleration of 0 to 10 $m/s^2$ for a second duration of 120 s.

3. The apparatus (10; 20; 30; 40; 60) of claim 1, wherein:

said mount (140; $\mathbf{140}_1$, $\mathbf{140}_2$) attaches said container (500; $\mathbf{500}_1$, $\mathbf{500}_2$; 500') such that said rotational axis (150) passes through said closed or sealed container containing the sample to be analyzed (500; $\mathbf{500}_1$, $\mathbf{500}_2$; 500') or a center point of said closed or sealed container containing the sample to be analyzed (500; $\mathbf{500}_1$, $\mathbf{500}_2$; 500'), said mount (140; $\mathbf{140}_1$, $\mathbf{140}_2$) attaches said container (500; $\mathbf{500}_1$, $\mathbf{500}_2$; 500') such that said rotational axis (150)

does not pass through said closed or sealed container containing the sample to be analyzed (500; 500$_1$, 500$_2$; 500'), or said centrifuge further comprises another drive (130$_1$, 130$_2$) coupled to said mount (140$_1$, 140$_2$) for rotating said attached closed or sealed container containing the sample to be analyzed (500; 500$_1$, 500$_2$; 500') about another rotational axis (150$_1$, 150$_2$) and centrifuging said moisture off said surface (522) in said attached closed or sealed container containing the sample to be analyzed (500; 500$_1$, 500$_2$; 500') and said mount (140$_1$, 140$_2$) attaches said closed or sealed container containing the sample to be analyzed (500; 500$_1$, 500$_2$; 500') such that said other rotational axis (150$_1$, 150$_2$) passes through said container (500, 500$_1$, 500$_2$; 500') or said center point of said closed or sealed container containing the sample to be analyzed (500, 500$_1$, 500$_2$; 500').

4. The apparatus (10; 20; 30; 40; 60) of claim 1, adapted to:

provide said heat energy at a temperature of 25° C. to 600° C., provide said heat energy at a temperature of 10 K to 20 K below a melting point of said closed or sealed container containing the sample to be analyzed (500; 500$_1$, 500$_2$; 500'), provide said heat energy for a duration of 1 s to 500 s, provide said heat energy using hot air or circulating hot air, or provide said heat energy in direct contact to a window on a cover (520, 520$_1$, 520$_2$) of said attached closed or sealed container containing the sample to be analyzed (500; 500$_1$, 500$_2$; 500'), wherein said surface (522) is situated on said window.

5. The apparatus (10; 20; 30; 40; 60) of claim 1, adapted to:

evaporate said moisture from said surface (522) after centrifuging said moisture off said surface (522), or evaporate said moisture from said surface (522) while centrifuging said moisture off said surface (522).

6. The apparatus (10; 20; 30; 40; 60) of claim 1, wherein:

said surface (522) is formed hydrophobic, or said surface (522) is formed hydrophilic.

7. The apparatus (10; 20; 30; 40; 60) of claim 1, adapted to:

rotate said attached closed or sealed container containing the sample to be analyzed (500; 500$_1$, 500$_2$; 500') at a centrifugal acceleration of 10 m/s$^2$ to 10000 m/s$^2$, or to rotate said attached closed or sealed container containing the sample to be analyzed (500; 500$_1$, 500$_2$; 500') for a duration of 3 s to 300 s.

8. The apparatus (10; 20; 30; 40; 60) of claim 1, adapted to:

provide said heat energy at a temperature of 50° C. to 150° C., or provide said heat energy for a duration of 3 to 300 s.

9. The apparatus (10; 20; 30; 40; 60) of claim 1, wherein the closed or sealed container containing the sample to be analyzed is a Petri dish, test tube or PCR tube.

10. A method (70) for removing moisture from a surface (522) in a closed or sealed container containing a sample to be analyzed (500; 500$_1$, 500$_2$; 500'), said method comprising:

centrifuging said moisture off said surface (522) in said closed or sealed container containing the sample to be analyzed (500; 500$_1$, 500$_2$; 500') using a centrifuge comprising a mount (140; 140$_1$, 140$_2$) attaching said closed or sealed container containing the sample to be analyzed (500; 500$_1$, 500$_2$; 500') to said centrifuge and a drive (105) coupled to said mount (140; 140$_1$, 140$_2$) rotating said attached closed or sealed container containing the sample to be analyzed (500; 500$_1$, 500$_2$; 500') about a rotational axis (150); and evaporating said moisture from said surface (522) in said attached closed or sealed container containing the sample to be analyzed (500; 500$_1$, 500$_2$; 500') using a heat source (200) providing heat energy.

11. The method (70) of claim 10, wherein:

said attached closed or sealed container containing the sample to be analyzed (500; 500$_1$, 500$_2$; 500') is rotated at a centrifugal acceleration of 1 m/s$^2$ to 5000 m/s$^2$, said attached closed or sealed container containing the sample to be analyzed (500; 500$_1$, 500$_2$; 500') is rotated for a duration of 1 s to 500 s, said attached closed or sealed container containing the sample to be analyzed (500; 500$_1$, 500$_2$; 500') is rotated at a centrifugal acceleration of 300 m/s$^2$ for a duration of 10 s, or said attached closed or sealed container containing the sample to be analyzed (500; 500$_1$, 500$_2$; 500') is rotated at a first centrifugal acceleration of 300 m/s$^2$ for a first duration of 10 s and, thereafter, a second centrifugal acceleration of 0 to 10 m/s$^2$ for a second duration of 120 s.

12. The method (70) of claim 10, wherein:

said closed or sealed container containing the sample to be analyzed (500; 500$_1$, 500$_2$; 500') is attached to said mount (140; 140$_1$, 140$_2$) such that said rotational axis (150) passes through said closed or sealed container containing the sample to be analyzed (500; 500$_1$, 5002; 500') or a center point of said closed or sealed container containing the sample to be analyzed (500; 500$_1$, 500$_2$; 500'), said closed or sealed container containing the sample to be analyzed (500; 500$_1$, 500$_2$; 500') is attached to said mount (140; 140$_1$, 140$_2$) such that said rotational axis (150) does not pass through said closed or sealed container containing the sample to be analyzed (500; 500$_1$, 500$_2$; 500'), or said centrifuge further comprises another drive (130$_1$, 130$_2$) coupled to said mount (140$_1$, 140$_2$) rotating said attached closed or sealed container containing the sample to be analyzed (500; 500$_1$, 500$_2$; 500') about another rotational axis (150$_1$, 150$_2$) and centrifuging said moisture off said surface (522) in said attached closed or sealed container containing the sample to be analyzed (500; 500$_1$, 500$_2$; 500') and said closed or sealed container containing the sample to be analyzed (500; 500$_1$, 500$_2$; 500') is attached to said mount (140$_1$, 140$_2$) such that said other rotational axis (150$_1$, 150$_2$) passes through said closed or sealed container containing the a sample to be analyzed (500; 500$_1$, 500$_2$; 500') or said center point of said closed or sealed container containing the sample to be analyzed (500; 500$_1$, 500$_2$; 500').

13. The method (70) of claim 10, wherein:

said heat energy is provided at a temperature of 25° C. to 600° C., said heat energy is provided at a temperature of 10 K to 20 K below a melting point of said closed or sealed container containing the sample to be analyzed (500; 500$_1$, 500$_2$; 500'), said heat energy is provided for a duration of between 1 s and 500 s, said heat energy is provided using hot air or circulating hot air, or said heat energy is provided in direct contact to a window on a cover (520, 520$_1$, 520$_2$) of said attached closed or sealed container containing the sample to be analyzed (500; 500$_1$, 500$_2$; 500'), wherein said surface (522) is situated on said window.

14. The method (70) of claim 10, wherein:

said moisture is evaporated from said surface (522) after said moisture is centrifuged off said surface (522), or said moisture is evaporated from said surface (522) while said moisture is centrifuged off said surface (522).

15. The method (70) of claim 10, wherein:

said surface (522) is formed hydrophobic, or said surface (522) is formed hydrophilic.

16. The method of claim 10, wherein the closed or sealed container containing the sample to be analyzed is a Petri dish, test tube or PCR tube.

17. The method of claim 10, wherein the surface of the closed or sealed container containing the sample to be analyzed contains as the sample to be analyzed a single cell or living microorganisms.

* * * * *